US007720231B2

(12) United States Patent
Breebaart

(10) Patent No.: US 7,720,231 B2
(45) Date of Patent: May 18, 2010

(54) ENCODING AUDIO SIGNALS

(75) Inventor: Dirk Jeroen Breebaart, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1085 days.

(21) Appl. No.: 10/573,310

(22) PCT Filed: Sep. 16, 2004

(86) PCT No.: PCT/IB2004/051775

§ 371 (c)(1),
(2), (4) Date: Mar. 24, 2006

(87) PCT Pub. No.: WO2005/031704

PCT Pub. Date: Apr. 7, 2005

(65) Prior Publication Data

US 2007/0036360 A1 Feb. 15, 2007

(30) Foreign Application Priority Data

Sep. 29, 2003 (EP) ..... 03103591

(51) Int. Cl.
*H04R 5/00* (2006.01)

(52) U.S. Cl. ..... 381/23; 379/406.13; 342/196; 704/E19.005

(58) Field of Classification Search ..... 381/23, 381/21, 20, 19, 1, 98; 704/E19.001, E19.005; 708/401, 402, 403, 404, 405; 379/406.12, 379/406.13; 342/195, 196
See application file for complete search history.

(56) References Cited

U.S. PATENT DOCUMENTS 6,823,018 B1 * 11/2004 Jafarkhani et al. ..... 375/245
2003/0026441 A1 2/2003 Faller
2004/0091118 A1 * 5/2004 Griesinger ..... 381/20

OTHER PUBLICATIONS

Breebaart et al: "High-Quality Parametric Spatial Audio Coding at Low Bitrates"; Preprints of Papers Presented at the 116th AES Convention, May 8, 2004, pp. 1-13, XP009042418.
Schuijers et al: "Advances in Parametric Coding for High-Quality Audio": Preprints of Papers Presented at the 114th AES Convention, Mar. 22, 2003, pp. 1-11, XP008021606.
Ekstrand, P. "Bandwidth Extension of Audio Signals by Spectral Band Replication." Proc. 1st Benelux Workshop on Model Based Processing and Coding of Audio (MPCA-2002), Leuven, Belgium.
International Search Report of International Application No. PCT/IB2004/051775 Contained in International Publication No. WO2005/031704.
Written Opinion of the International Searching Authority for International Application No. PCT/IB2004/051775.

* cited by examiner

*Primary Examiner*—Xu Mei
*Assistant Examiner*—Con P Tran

(57) ABSTRACT

The encoder transforms the audio signals (x(n),y(n)) from the time domain to audio signal (X(k),Y(k)) in the frequency domain, and determines the cross-correlation function (Ri, Pi) in the frequency domain. A complex coherence value (Qi) is calculated by summing the (complex) cross-correlation function values (Ri, Pi) in the frequency domain. The inter-channel phase difference (IPDi) is estimated by the argument of the complex coherence value (Qi), and the inter-channel coherence (ICi) is estimated by the absolute value of the complex coherence value (Qi).

6 Claims, 3 Drawing Sheets

ENCODING AUDIO SIGNALS

FIELD OF THE INVENTION

The invention relates to an encoder for audio signals, and a method of encoding audio signals.

BACKGROUND OF THE INVENTION

Within the field of audio coding it is generally desired to encode an audio signal in order to reduce the bit rate without unduly compromising the perceptual quality of the audio signal. The reduced bit rate is advantageous for limiting the bandwidth when communicating the audio signal or the amount of storage required for storing the audio signal.

Parametric descriptions of audio signals have gained interest during the last years, especially in the field of audio coding. It has been shown that transmitting (quantized) parameters which describe audio signals require only a limited transmission capacity to enable to synthesize perceptually substantially equal audio signals at the receiving end.

US2003/0026441 discloses the synthesizing of an auditory scene by applying two or more different sets of one or more spatial parameters (e.g. an inter-ear level difference ILD, or an inter-ear time difference ITD) to two or more different frequency bands of a combined audio signal, wherein each different frequency band is treated as if it corresponds to a single audio source in the auditory scene. In one embodiment, the combined audio signal corresponds to the combination of the left and right audio signals of a binaural signal corresponding to an input auditory scene. The different sets of spatial parameters are applied to reconstruct the input auditory scene. The transmission bandwidth requirements are reduced by reducing to one the number of different audio signals that need to be transmitted to a receiver configured to synthesize/reconstruct the auditory scene.

In the transmitter, a TF transform is applied to corresponding parts of each of the left and right audio signals of the input binaural signal to convert the signals to the frequency domain. An auditory scene analyzer processes the converted left and right audio signals in the frequency domain to generate a set of auditory scene parameters for each one of a plurality of different frequency bands in those converted signals. For each corresponding pair of frequency bands, the analyzer compares the converted left and right audio signals to generate one or more spatial parameters. In particular, for each frequency band, the cross-correlation function between the converted left and right audio signals is estimated. The maximum value of the cross-correlation indicates how much the two signals are correlated. The location in time of the maximum of the cross-correlation corresponds to the ITD. The ILD can be obtained by computing the level difference of the power values of the left and right audio signals.

SUMMARY OF THE INVENTION

It is an object of the invention to provide an encoder for encoding audio signals which requires less processing power.

To reach this object, a first aspect of the invention provides an encoder for encoding audio signals. A second aspect of the invention provides a method of encoding audio signals. Advantageous embodiments are defined in the dependent claims.

The encoder disclosed in US2003/0026441 first transforms the audio signals from the time domain to the frequency domain. This transformation is usually referred to as the Fast Fourier Transform, further referred to as FFT. Usually, the audio signal in the time domain is divided into a sequence of time segments or frames, and the transformation to the frequency domain is performed sequentially for each one of the frames. The relevant part of the frequency domain is divided into frequency bands. In each frequency band the cross-correlation function is determined of the input audio signals. This cross-correlation function has to be transformed from the frequency domain to the time domain. This transformation is usually referred to as the inverse FFT further referred to as IFFT. In the time domain, the maximum value of the cross-correlation function has to be determined to find the location in time of this maximum and thus the value of the ITD.

The encoder in accordance with the first aspect of the invention also has to transform the audio signals from the time domain to the frequency domain, and also has to determine the cross-correlation function in the frequency domain. In the encoder in accordance with the invention, the spatial parameter used is the inter-channel phase difference further referred to as IPD or the inter-channel coherence further referred to as IC, or both. Also other spatial parameters such as the inter-channel level differences further referred to as ILD may be coded. The inter-channel phase difference IPD is comparable with the inter-ear time difference ITD of the prior art.

However instead of performing the IFFT and the search for the maximum value of the cross-correlation function in the time domain, a complex coherence value is calculated by summing the (complex) cross-correlation function values in the frequency domain. The inter-channel phase difference IPD is estimated by the argument of the complex coherence value, the inter-channel coherence IC is estimated by the absolute value of the complex coherence value.

In the prior art US2003/0026441, the inverse FFT and the search for the maximum of the cross-correlation function in the time domain requires a high amount of processing effort. This prior art is silent about the determination of the coherence parameter.

In the encoder in accordance with the invention the inverse FFT is not required, the complex coherence value is calculated by summing the (complex) cross-correlation function values in the frequency domain. Either the IPD or the IC, or the IPD and the IC are determined in a simple manner from this sum. Thus, the high computational effort for the inverse FFT is replaced by a simple summing operation. Consequently, the approach in accordance with the invention requires less computational effort.

It should be noted that although prior art US2003/0026441 uses an FFT to yield a complex-valued frequency-domain representation of the input signals, complex filter banks may also be used. Such filter banks use complex modulators to obtain a set of band-limited complex signals (cf. Ekstrand, P. (2002). Bandwidth extension of audio signals by spectral band replication. Proc. 1st Benelux Workshop on model based processing and coding of audio (MPCA-2002), Leuven, Belgium). The IPD and IC parameters can be computed in a similar way as for the FFT, with the only difference that summation is required across time instead of frequency bin.

In an embodiment of the invention, the cross-correlation function is calculated as a multiplication of one of the input audio signals in a band-limited, complex domain and the complex conjugated other one of the input audio signals to obtain a complex cross-correlation function which can be thought to be represented by an absolute value and an argument.

In further embodiment of the invention, a corrected cross-correlation function is calculated as the cross-correlation function wherein the argument is replaced by the derivative of said argument. At high frequencies, it is known that the human auditory system is not sensitive to fine-structure phase-differences between the two input channels. However, considerable sensitivity to the time difference and coherence of the envelope exists. Hence at high frequencies, it is more relevant to compute the envelope ITD and envelope coherence for each frequency band. However, this requires an additional step of computing the (Hilbert) envelope. In the embodiment in accordance with the invention as defined in claim 3, it is possible to calculate the complex coherence value by summing the corrected cross-correlation function directly in the frequency domain. Again, the IPD and/or IC can be determined in a simple manner from this sum as the argument and phase of the sum, respectively.

In a further embodiment of the invention, the frequency domain is divided into a predetermined number of frequency sub-bands, further also referred to as sub-bands. The frequency range covered by different sub-bands may increase with the frequency. The complex cross-correlation function is determined for each sub-band, by using both the input audio signals in the frequency domain in this sub-band. The input audio signals in the frequency domain in a particular one of the sub-bands are also referred to as sub-band audio signals. The result is a cross-correlation function for each one of the sub-bands. Alternatively, the cross-correlation function may only be determined for a sub-set of the sub-bands, depending on the required quality of the synthesized audio signals. The complex coherence value is calculated by summing the (complex) cross-correlation function values in each of the sub-bands. And thus, also the IPD and/or IC are determined per sub-band. This sub-band approach enables to provide a different coding for different frequency sub-bands and allows to further optimize the quality of the decoded audio signal versus the bit-rate of the coded audio signal.

In a further embodiment of the invention, for lower frequencies, the complex cross-correlation functions per sub-band are obtained by multiplying one of the sub-band audio signals with the complex conjugated other one of the sub-band audio signals. The complex cross-correlation function has an absolute value and an argument. The complex coherence value is obtained by summing the values of the cross-correlation function in each of the sub-bands. For higher frequencies, corrected cross-correlation functions are determined which are determined in the same manner as the cross-correlation functions for lower frequencies but wherein the argument is replaced by a derivative of this argument. Now, the complex coherence value per sub-band is obtained by summing the values of the corrected cross-correlation function per sub-band. The IPD and/or IC are determined in the same manner from the complex coherence value, independent on the frequency.

These and other aspects of the invention are apparent from and will be elucidated with reference to the embodiments described hereinafter.

DETAILED DESCRIPTION OF THE PREFERRED EMBODIMENT

Figure 1:
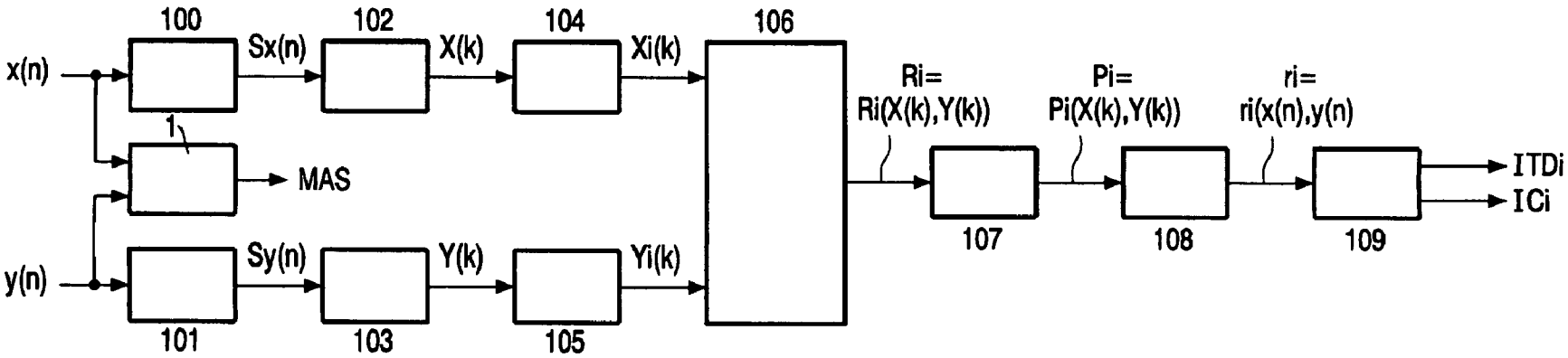
FIG. 1 shows a block diagram of an audio encoder.

FIG. 1 shows a block diagram of an audio encoder. The audio encoder receives two input audio signals x(n) and y(n) which are digitized representations of, for example, the left audio signal and the right audio signal of a stereo signal in the time domain. The indices n refer to the samples of the input audio signals x(n) and y(n). The combining circuit 1 combines these two input audio signals x(n) and y(n) into a monaural signal MAS. The stereo information in the input audio signals x(n) and y(n) is parameterized in the parameterizing circuit 10 which comprises the circuits 100 to 113 and supplies, by way of example only, the parameters ITDi, the inter-channel time difference per frequency sub-band (or the IPDi: inter-channel phase difference per frequency sub-band) and Cli (inter-channel coherence per frequency sub-band). The monaural signal MAS and the parameters ITDi, ICi are transmitted in a transmission system or stored on a storage medium (not shown). At the receiver or decoder (not shown) the original signals x(n) and y(n) are reconstructed from the monaural signal MAS and the parameters ITDi, ICi.

Usually, the input audio signals x(n) and y(n) are processed per time segment or frame. The segmentation circuit 100 receives the input audio signal x(n) and stores the received samples during a frame to be able to supply the stored samples Sx(n) of the frame to the FFT-circuit 102. The segmentation circuit 101 receives the input audio signal y(n) and stores the received samples during a frame to be able to supply the stored samples Sy(n) of the frame to the FFT-circuit 103.

The FFT-circuit 102 performs a Fast Fourier Transformation on the stored samples Sx(n) to obtain an audio signal X(k) in the frequency domain. In the same manner, the FFT-circuit 103 performs a Fast Fourier Transformation on the stored samples Sy(n) to obtain an audio signal Y(k) in the frequency domain. The sub-band dividers 104 and 105 receive the audio signals X(k) and Y(k), respectively, to divide the frequency spectra of these audio signals X(k) and Y(k) into frequency sub-bands i (see FIG. 4) to obtain the sub-band audio signals Xi(k) and Yi(k). This operation is further elucidated with respect to FIG. 4.

The cross-correlation determining circuit 106 calculates the complex cross-correlation function Ri of the sub-band audio signals Xi(k) and Yi(k) for each relevant sub-band. Usually, the cross-correlation function Ri is obtained in each relevant sub-band by multiplying one of the audio signals in the frequency domain Xi(k) with the complex conjugated other one of the audio signals in the frequency domain Yi(k). It would be more correct to indicate the cross-correlation function with Ri(X,Y)(k) or Ri(X(k),Y(k)), but for clarity this is abbreviated to Ri.

The optional normalizing circuit 107 normalizes the cross-correlation function Ri to obtain a normalized cross-correlation function Pi(X,Y)(k) or Pi(X(k),Y(k)) which is abbreviated to Pi:

$$Pi=Ri(Xi,Yi)/\mathrm{sqrt}(\mathrm{sum}(Xi(k)\cdot\mathrm{conj}Xi(k))*(\mathrm{sum}Xi(k)\cdot\mathrm{conj}Xi(k)))$$

wherein sqrt is the square root, and conj is the complex conjugation. It is to be noted that this normalization process requires the computation of the energies of the sub-band signals Xi(k), Yi(k) of the two input signals x(n), y(n). However, this operation is required anyway in order to compute the inter-channel intensity difference IID for the current subband i. The IID is determined by the quotient of these energies. Thus, the cross function Ri can be normalized by taking the goniometric mean of the corresponding sub-band intensities of the two input signals Xi(k), Yi(k).

The known IFFT (Inverse Fast Fourier Transform) circuit 108 transforms the normalized cross-correlation function Pi in the frequency domain back to the time domain, yielding the normalized cross-correlation ri(x(n),y(n)) or ri(x,y)(n) in the time domain which is abbreviated as ri. The circuit 109 determines the peak value of the normalized cross-correlation ri. The inter-channel time delay ITDi for a particular sub-band is the argument n of the normalized cross-correlation ri at which the peak value occurs. Or said in other words, the delay which corresponds to this maximum in the normalized cross-correlation ri is the ITDi. The inter-channel coherence ICi for the particular sub-band is the peak value. The ITDi provides the required shift of the two input audio signals x(n), y(n) with respect to each other to obtain the highest possible similarity. The ICi indicates how similar the shifted input audio signals x(n), y(n) are in each sub-band. Alternatively, the IFFT may be performed on the not normalized cross-correlation function Ri.

Although this block diagram shows separate blocks performing operations, the operations may be performed by a single dedicated circuit or integrated circuit. It is also possible to perform all the operations or a part of the operations by a suitably programmed microprocessor.

Figure 2:
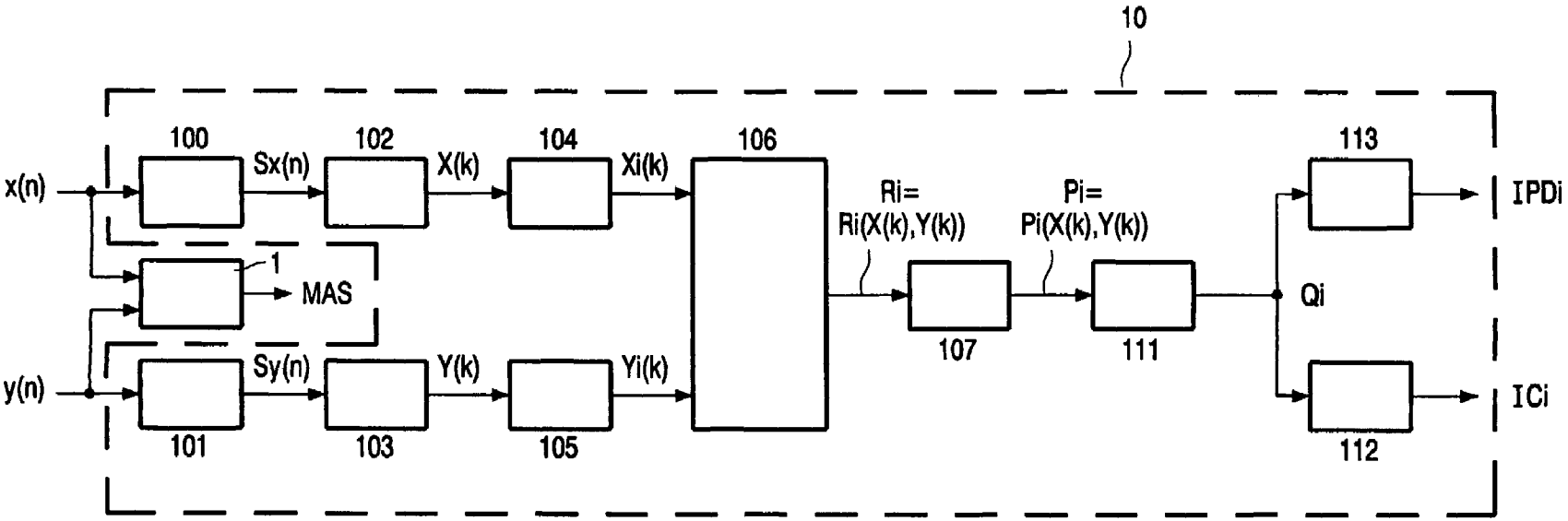
FIG. 2 shows a block diagram of an audio encoder of an embodiment in accordance with the invention.

FIG. 2 shows a block diagram of an audio encoder of an embodiment in accordance with the invention. This audio encoder comprises the same circuits 1, and 100 to 107 as shown in FIG. 1 which operate in the same manner. Again, the optional normalizing circuit 107 normalizes the cross-correlation function Ri to obtain a normalized cross-correlation function Pi. The coherence value computing circuit 111 computes a complex coherence value Qi for each relevant sub-band i by summing the complex normalized cross-correlation function Pi:

$$Qi=\mathrm{sum}(Pi(Xi(k),Yi(k)))$$

The FFT-bin index k is determined by the bandwidth of each sub-band. Preferably, to minimize computation efforts, only the positive (k=0 to K/2, where K is the FFT size) or negative frequencies (k=−K/2 to 0) are summed. This computation is performed in the frequency domain and thus does not require an IFFT to first transform the normalized cross-correlation function Pi to the time domain. The coherence estimator 112 estimates the coherence ICi with the absolute value of the complex coherence value Qi. The phase difference estimator 113 estimates the IPDi with the argument or angle of the complex coherence value Qi.

Thus now, the inter-channel coherence ICi and the inter-channel phase difference IPDi are obtained for each relevant sub-band i without requiring, in each relevant sub-band, an IFFT operation and a search for the maximum value of the normalized cross-correlation ri. This saves a considerable amount of processing power. Alternatively, the complex coherence value Qi may be obtained by summing the not normalized cross-correlation function Ri.

Figure 3:
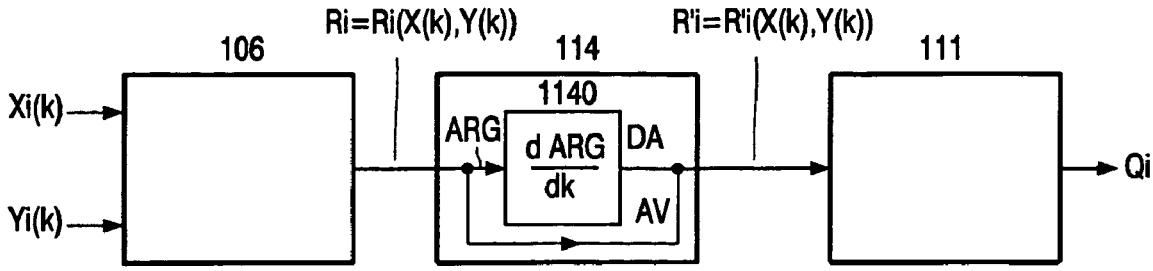
FIG. 3 shows a block diagram of part of the audio encoder of another embodiment in accordance with the invention.

FIG. 3 shows a block diagram of part of the audio encoder of another embodiment in accordance with the invention.

For high frequencies, for example above 2 kHz or above 4 kHz, in the prior art (cf. Baumgarte, F., Faller. C (2002). Estimation of auditory spatial cues for binaural cue coding. Proc. ICASSP'02), the envelope coherence may be calculated which is even more computational intensive than computing the waveform coherence as elucidated with respect to FIG. 1. Experimental results demonstrated that the envelope coherence can be fairly accurately estimated by replacing the phase values ARG of the frequency domain (normalized) complex cross-correlation function Ri by the derivative DA of these phase values ARG.

FIG. 3 shows the same cross-correlation determining circuit 106 as in FIG. 1. The cross-correlation determining circuit 106 calculates the complex cross-correlation function Ri of the sub-band audio signals Xi(k) and Yi(k) for each relevant sub-band. Usually, the cross-correlation function Ri is obtained in each relevant sub-band by multiplying one of the audio signals in the frequency domain Xi(k) with the complex conjugated other one of the audio signals in the frequency domain Yi(k). The circuit 114 which receives the cross-correlation function Ri comprises a calculation unit 1140 which determines the derivative DA of the argument ARG of this complex cross-correlation function Ri. The amplitude AV of the cross-correlation function Ri is unchanged. The output signal of the circuit 114 is a corrected cross-correlation function R'i(Xi(k),Yi(k)) (which is also referred to as R'i) which has the amplitude AV of the cross-correlation function Ri and an argument which is the derivative DA of the argument ARG:

$$|R'i(Xi(k),Yi(k))|=|Ri(Xi(k),Yi(k))| \text{ and}$$

$$\arg(R'i(Xi(k),Yi(k)))=d(\arg(Ri(Xi(k),Yi(k))))/dk$$

The coherence value computing circuit 111 computes a complex coherence value Qi for each relevant sub-band i by summing the complex cross-correlation function R'i. Thus, instead of the computational intensive Hilbert envelope approach now only simple operations are required.

The above described approach can of course also be applied on the normalized complex cross-correlation function Pi to obtain a corrected complex normalized cross-correlation function P'i.

Figure 4:
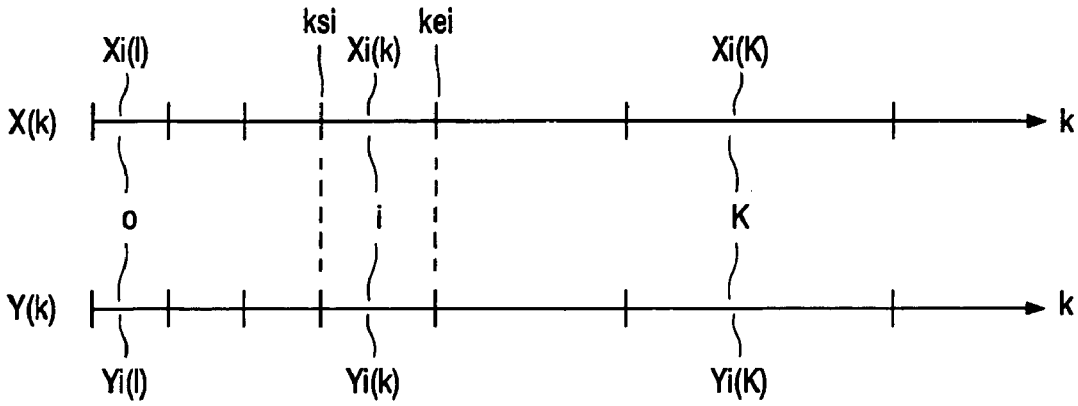
FIG. 4 shows a schematic representation of the sub-band division of the audio signals in the frequency domain.

FIG. 4 shows a schematic representation of the sub-band division of the audio signals in the frequency domain. FIG. 4A shows how the audio signal X(k) in the frequency domain is divided into sub-band audio signals Xi(k) in sub-bands i of the frequency spectrum f. FIG. 4B shows how the audio signal Y(k) in the frequency domain is divided into sub-band audio signals Yi(k) in sub-bands i of the frequency spectrum f. The frequency-domain signals X(k) and Y(k) are grouped into sub-bands i, resulting in sub-bands Xi(k) and Yi(k). Each sub-band Xi(k) corresponds to a certain range of FFT-bin indexes k=[ksi . . . kei], where ksi and kei indicate the first and last FFT bin index k, respectively. Similarly each subband Yi(k) corresponds to the same range of FFT-bin indexes k.

It should be noted that the above-mentioned embodiments illustrate rather than limit the invention, and that those skilled in the art will be able to design many alternative embodiments without departing from the scope of the appended claims.

The invention is not limited to stereo signals and may, for example, be implemented on multi-channel audio as used in DVD and SACD.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. An encoder for encoding audio signals, the encoder comprising means (1) for generating a monaural signal (MAS) comprising a combination of at least two input audio signals (x(n), y(n)), and means (10) for generating a set of spatial parameters (IPDi; ICi) indicative of spatial properties of the at least two input audio signals (x(n),y(n)), wherein the set of spatial parameters (IPDi; ICi) at least comprises an inter-channel coherence value (ICi) and/or an inter-channel phase difference value (IPDi), and wherein the means (10) for generating the set of spatial parameters (IPDi; ICi) comprises means (106; 106, 107) for generating a cross-correlation function (Ri; Pi) of the at least two input audio signals (x(n), y(n)), means (111) for determining a complex coherence value (Qi) by summing values of the cross-correlation function (Ri; Pi), and means (112) for determining an absolute value of the complex coherence value (Qi) to obtain an estimate of the inter-channel coherence value (ICi), and/or means (113) for determining an argument of the complex coherence value (Qi) to obtain an estimate of the inter-channel phase difference value (IPDi).

2. An encoder for encoding audio signals as claimed in claim 1, wherein the means (10) for generating the set of spatial parameters (IPDi; ICi) comprises means (102, 103) for transforming the input audio signals (x(n), y(n)) into a frequency or sub-band domain to obtain audio signals in the frequency or sub-band domain (X(k), Y(k)), and wherein the means (106; 106, 107) for generating the cross-correlation function (Ri; Pi) are arranged for calculating a complex cross-correlation function (Ri; Pi) as a multiplication of one of the audio signals in the frequency or sub-band domain (X(k), Y(k)) and the complex conjugated other one of the audio signals in the frequency or sub-band domain (X(k), Y(k)).

3. An encoder for encoding audio signals as claimed in claim 2, wherein the means (106; 106, 107) for generating the cross-correlation function (Ri; Pi) are arranged for calculating a corrected cross-correlation function (R'i) being the cross-correlation function (Ri) wherein its argument (ARG) is replaced by a derivative (DA) of said argument (ARG), and wherein the means (111) for determining the complex coherence value (Qi) is arranged for summing the values of the corrected cross-correlation function (R'i).

4. An encoder for encoding audio signals as claimed in claim 1, wherein the means (10) for generating the set of spatial parameters (IPDi; ICi) comprises means (102, 103) for transforming the input audio signals (x(n), y(n)) into a frequency domain to obtain audio signals in the frequency domain (X(k), Y(k)), and means (104, 105) for dividing the audio signals in the frequency domain (X(k), Y(k)) into corresponding pluralities of sub-band signals (Xi(k), Yi(k)) associated with frequency sub-bands (i), and wherein the means (106; 106, 107) for generating the cross-correlation function (Ri; Pi) is arranged for determining the cross-correlation function (Ri); Pi) from the sub-band signals (Xi(k), Yi(k)) for at least each one of the frequency sub-bands (i) belonging to a subset of the frequency sub-bands (i), the means (111) for determining the complex coherence value (Qi) is arranged for summing the values of the cross-correlation function (Ri; Pi) in at least each one of the frequency sub-bands (i) belonging to the subset, and the means (112) for determining the absolute value of the complex coherence value (Qi) is arranged for obtaining the estimate of the coherence value (ICi) for at least each one of the frequency sub-bands (i) of the subset, and/or the means (113) for determining the argument of the complex coherence value (Qi) is arranged for obtaining the inter-channel phase difference value (IPDi) for at least each one of the frequency sub-bands (i) of the subset.

5. An encoder for encoding audio signals as claimed in claim 4, wherein the means (106; 106, 107) for generating the cross-correlation function (Ri; Pi) are arranged for calculating:

for frequency sub-bands (i) below a predetermined frequency, the cross-correlation functions (Ri; Pi) as a multiplication of one of the sub-band signals (Xi(k), Yi(k)) and the complex conjugated other one of the sub-band signals (Xi(k), Yi(k)), wherein the means (111) for determining the complex coherence value (Qi) is arranged for summing the values of the cross-correlation function (Ri; Pi) in at least each one of the frequency sub-bands (i) of the subset, and for frequency sub-bands (i) above the predetermined frequency, corrected cross-correlation functions (R'i) being the cross-correlation function (Ri) wherein its argument (ARG) is replaced by a derivative (DA) of said argument (ARG), and wherein the means (111) for determining the complex coherence value (Qi) is arranged for summing the values of the corrected cross-correlation function (R'i) in at least each one of the frequency sub-bands (i) of the subset.

6. A method of encoding audio signals, the method comprising generating (1) a monaural signal (MAS) comprising a combination of at least two input audio signals (x(n), y(n)), and generating (10) a set of spatial parameters (IPDi; ICi) indicative of spatial properties of the at least two input audio signals (x(n), y(n)), wherein the set of spatial parameters (IPDi; ICi) at least comprises an inter-channel coherence value (ICi) and/or an inter-channel phase difference value (IPDi), and wherein the step of generating (10) the set of spatial parameters (IPD; IC) comprises generating (106; 106, 107) a cross-correlation function (Ri; Pi) of the at least two input audio signals (x(n), y(n)) in a frequency domain, determining (111) a complex coherence value (Qi) by summing values of the cross-correlation function (Ri; Pi), and determining (112) an absolute value of the complex coherence value (Qi) to obtain an estimate of the inter-channel coherence value (ICi), and/or determining (113) an argument of the complex coherence value (Qi) to obtain an estimate of the inter-channel phase difference value (IPDi).

* * * * *